United States Patent [19]

Cody

[11] 4,106,256

[45] Aug. 15, 1978

[54] ADJUSTABLE SHORING APPARATUS

[75] Inventor: David L. Cody, Hoffman Estates, Ill.

[73] Assignee: Symons Corporation, Des Plaines, Ill.

[21] Appl. No.: 746,314

[22] Filed: Dec. 1, 1976

[51] Int. Cl.[2] ..... E04H 12/18

[52] U.S. Cl. ..... 52/646; 52/126; 52/694; 249/28

[58] Field of Search ..... 52/646, 690, 693, 691, 52/648, 122, 645, 637, 692; 249/18, 24, 28

[56] References Cited

U.S. PATENT DOCUMENTS

| | | | |
|---|---|---|---|
| 2,114,902 | 4/1938 | Henderson | 52/692 |
| 3,826,057 | 7/1974 | Franklin | 52/641 |
| 3,977,536 | 8/1976 | Moore et al. | 249/18 X |

*Primary Examiner*—Ernest R. Purser
*Assistant Examiner*—Carl D. Friedman
*Attorney, Agent, or Firm*—Norman H. Gerlach

[57] ABSTRACT

Adjustable shoring apparatus includes upper and lower pairs of horizontally extending spaced apart parallel chords, a plurality of struts extending obliquely from the upper chord pair to the lower chord pair and between the chords in each pair in a continuous longitudinal series of strut pairs of like substantially V-shaped configuration having their apices at the lower chord pair, means connecting the upper and lower ends of the struts respectively to the chords of the upper and lower pairs in a truss-like structure adapted for supporting a load on the chords of the upper pair, a plurality of vertically extending elongated legs each having a vertical series of support pin holes which extend transversely therethrough, the legs having upper portions inserted between the chords in the lower pair and lower portions extending below the structure to provide support therefor, the legs being vertically reciprocally movable relative to the structure for adjusting the combined height thereof, the strut pairs in said series each being adapted for inserting one of the legs between the struts of and at the apex of the strut pair, the legs being inserted between the struts in respective selected strut pairs and being insertable alternatively between the struts of other strut pairs along the length of the structure for supporting the structure alternatively at said other locations, and means for supporting the structure on the legs adjustably at varying elevations including means carried by the chores in the lower pair and defining support pin holes, the hole-defining means being adapted for disposing the pin holes thereof on opposite sides of each leg for registry with the leg pin holes successively in any of said locations of the leg, and a support pin removably insertable through a selected one of the pin holes in each leg and through the pin holes of the hole-defining means in registry therewith for transferring the load forces from the hole-defining means to the legs.

8 Claims, 9 Drawing Figures

ADJUSTABLE SHORING APPARATUS

BACKGROUND OF THE INVENTION

This invention relates to adjustable shoring apparatus, in particular, to apparatus which is especially adapted for supporting a concrete form and which may be employed in unitary concrete form installations or assemblies of the flying deck type.

Vertically adjustable shoring apparatus has become increasingly popular for use in supporting concrete floor slab formwork, owing to the relative ease and rapidity with which the apparatus can be set up and used, and thereafter removed from beneath the floor slab and transported to another pour site. Efficiency has been increased by providing relatively large assemblies of shoring apparatus, which may be in modular form. It is especially advantageous to employ concrete form installations of the flying deck type, which are combinations of shoring apparatus and deck forms designed for use in the construction of multi-story structures having typical slabs. Concrete form installation units are placed in side-by-side and end-to-end relation, to provide a continuous deck form, which serves as a base for a concrete pour. After the floor slabs have hardened, the vertically adjustable shoring apparatus employed in the units is collapsed, permitting the units to be moved endwise or sidewise between the floors. The units are moved laterally from between the floors and transported or "flown" by means of a crane to the next adjacent upper floor level for reuse thereat. Examples of prior apparatus employed for the foregoing purposes include U.S. Pat. Nos. 3,826,057, 3,902,289 and 3,977,536, which disclose shoring apparatus embodying truss-like structures.

SUMMARY OF THE INVENTION

An important object of the present invention is to provide adjustable shoring apparatus which incorporates supporting legs both vertically adjustable to vary the overall height of the apparatus and horizontally adjustable as regards their positions along the length of the apparatus to provide support at varying locations therealong, for supporting a load in an optimum manner while reducing to a minimum the number of legs in the apparatus.

Another important object is to provide adjustable shoring apparatus which combines the features of strength, relatively light weight, adaptability and ease of assembly. More particularly, it is an object to provide such an apparatus which is adapted for use in any desired size and in modular form.

A particular object is to provide apparatus having the foregoing characteristics and which embodies a truss-like structure for strength and rigidity, and supporting legs combined therewith in a unitary apparatus. A more specific object is to provide such apparatus which is adapted for retracting the legs into out-of-the-way positions on the truss-like structure, to facilitate transportation of the apparatus and enable the apparatus to be moved on rollers in the course of transportation.

Another object is to provide adjustable shoring apparatus having the foregoing characteristics and which is adapted for use as a component of a unitary concrete form installation or assembly of the flying deck type, which installation may be assembled in varying heights, widths, and lengths, as desired.

An additional object is to provide an assembly of a plurality of units of adjustable shoring apparatus having the foregoing characteristics, and bridging structure which serves to interconnect the units, the assembly having uniform load-bearing characteristics throughout its structure.

Adjustable shoring apparatus according to the invention includes upper and lower pairs of spaced apart parallel chords having horizontally extending longitudinal axes, the chords in the lower pair being spaced beneath and vertically aligned with respective chords in the upper pair, a plurality of struts extending obliquely from the upper chord pair to the lower chord pair and between the chords in each pair in a continuous longitudinal series of strut pairs of like substantially V-shaped configuration having their apices at the lower chord pair, the center lines of successive strut pairs being uniformly spaced apart, means connecting the upper and lower ends of the struts respectively to the chords of the upper and lower pairs in a truss-like structure constructed essentially of the struts and the chords and adapted for supporting a load on the chords of the upper pair, a plurality of vertically extending elongated legs each having a vertical series of support pin holes which extend transversely therethrough, the legs having upper portions inserted between the chords in the lower pair and lower portions extending below the structure to provide support therefor, and the legs being vertically reciprocally movable relative to the structure for adjusting the combined height thereof, the strut pairs in said series each being adapted for inserting one of the legs between the struts of and at the apex of the strut pair, the legs being inserted between the struts in respective selected strut pairs and being insertable alternatively between the struts of other strut pairs and at other locations along the length of the structure for supporting the structure alternatively at said other locations, and means for supporting the structure on the legs adjustably at varying elevations including means carried by the chords in the lower pair and defining support pin holes, the hole-defining means being adapted for disposing the pin holes thereof on opposite sides of each leg for registry with the leg pin holes successively in any of said locations of the leg, and a support pin removably insertable through a selected one of the pin holes in each leg and through the pin holes of the hole-defining means in registry therewith for transferring the load forces from the hole-defining means to the legs.

A plurality of units of the apparatus are assembled in a preferred manner in accordance with the invention, in longitudinal alignment and adjacent to each other, the units being connected together at abutting upper pairs of chords in adjacent units, and with the addition of a pair of bridge members between spaced apart lower pairs of chords in adjacent units, and an additional like strut pair is provided, of substantially V-shaped configuration extending between adjacent units and having its apex at the bridge member pair.

Other objects, advantages, and features of the invention will become apparent from the following description of preferred embodiments of the invention, taken in conjunction with the accompanying drawings.

BRIEF DESCRIPTION OF THE DRAWINGS

The attached drawings illustrate preferred embodiments of the invention, without limitation thereto. In the drawings, like elements are identified by like reference symbols in each of the views, and.

DESCRIPTION OF THE PREFERRED EMBODIMENTS

Figure 1:
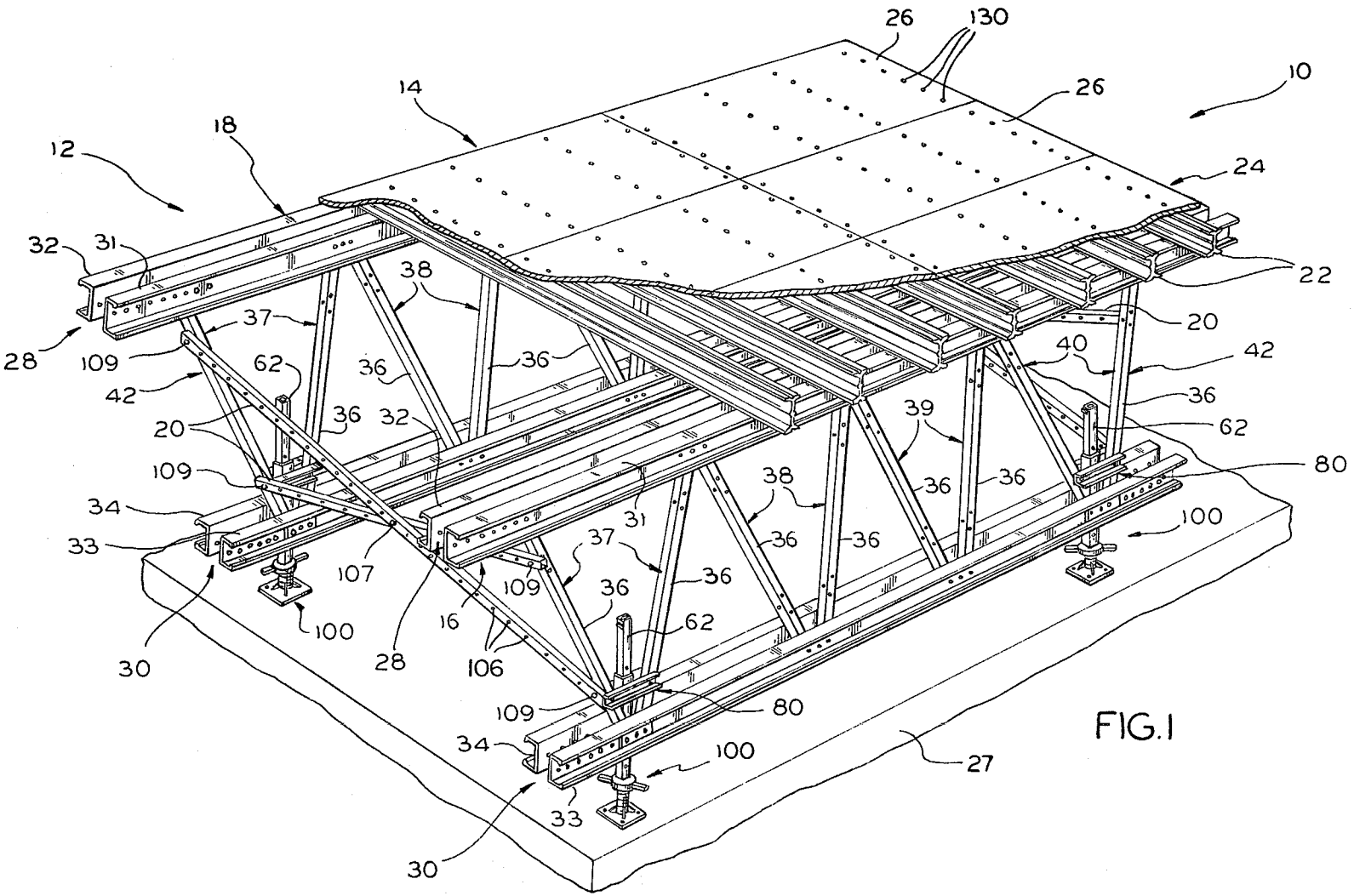
FIG. 1 is a perspective view of a concrete form installation or assembly unit of the flying deck type, with portions of the formwork thereof broken away and parts removed to reveal the shoring assembly unit thereof.

Referring to the drawings, FIG. 1 illustrates a concrete form installation or assembly unit 10 of the flying deck type constituting a preferred embodiment of the invention. The form installation unit 10 includes a shoring assembly unit 12 and a formwork unit 14 supported thereby. The shoring assembly unit 12 is a modular three-dimensional structure having as its principal components two like narrow, elongated shoring apparatus units 16 and 18. The shoring apparatus units 16 and 18 are rigidly secured together in spaced parallel transversely aligned relation by unit crossbraces 20 at the opposite ends of the shoring assembly unit 12. The formwork unit 14 is constructed of a plurality of spaced parallel joist-like structural members 22, which are seated on and connected to the shoring assembly unit 12, and extend transversely thereof. The formwork unit 14 also includes a deck 24 formed of rows of plywood panels 26, which are secured to the structural members 22.

The form installation unit 10 is assembled for use on a foundation or floor slab 27. The form installation unit 10 may be employed alone or with additional units of like character adjacent thereto in end-to-end and side-by-side relation, according to the requirements of the concrete floor to be formed thereon. A continuous deck is formed of the panels 26 or the like, and concrete is poured thereon and allowed to harden. Thereafter, the form installation unit 10 is lowered or collapsed, and then removed for use in another location. The form installation unit 10, with the exception of certain screw jacks thereof, is adapted to be transported completely, as a unit, both on a supporting surface and from one elevation to another. In particular, crane cables may be secured to the form installation unit 10, and the unit may be moved by means of a crane from one floor to another during the construction of a multi-story building. The shoring assembly unit 12 may be transported alone, with no formwork unit 14 thereon, in similar fashion.

The shoring apparatus units 16 and 18 also are adapted for individual use, without being interconnected. As an example, the units may be employed for the support of concrete beam forms. The shoring apparatus units 16 and 18 are capable of movement on a supporting surface and of being moved by a crane in similar fashion to the form installation unit 10 and the shoring assembly unit 12.

Figure 2:
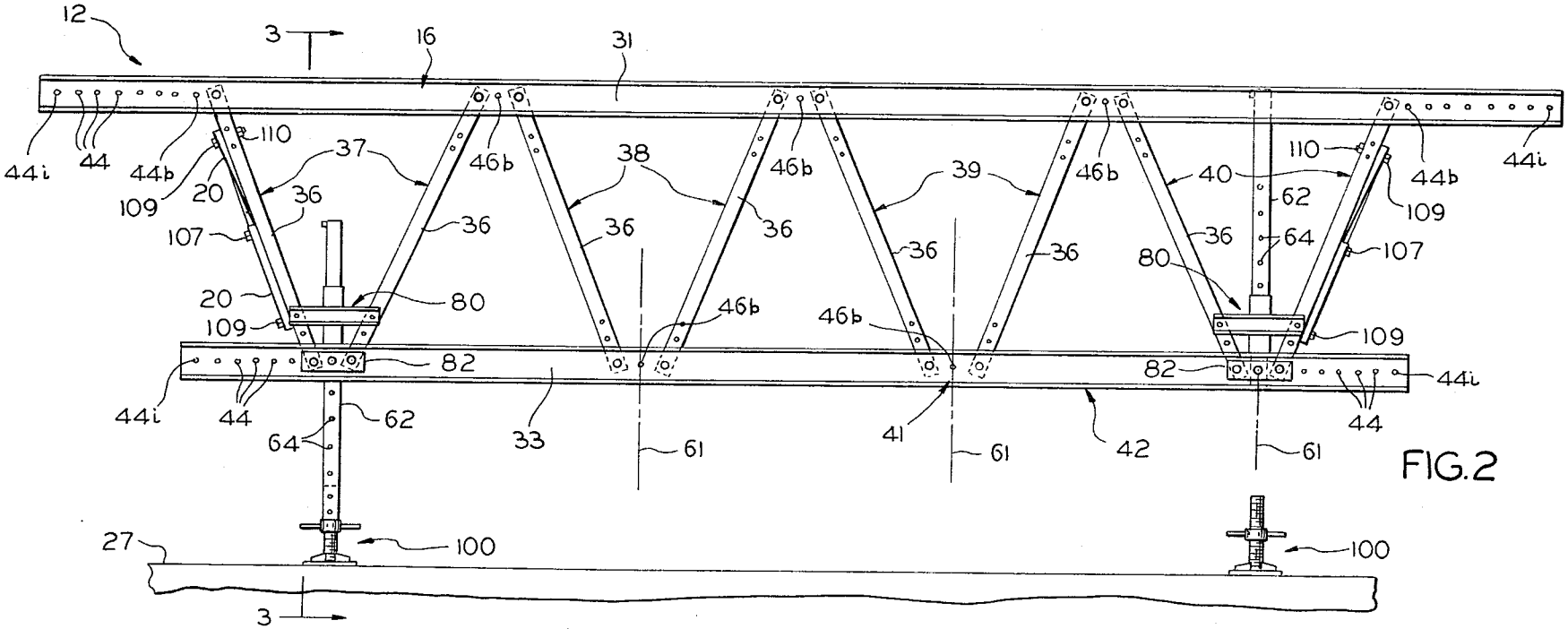
FIG. 2 is a side elevational view of a shoring assembly unit constituting part of the form installation unit of FIG. 1, illustrating a raised, out-of-the-way position for the legs thereof at one end of the assembly unit.
Figure 3:
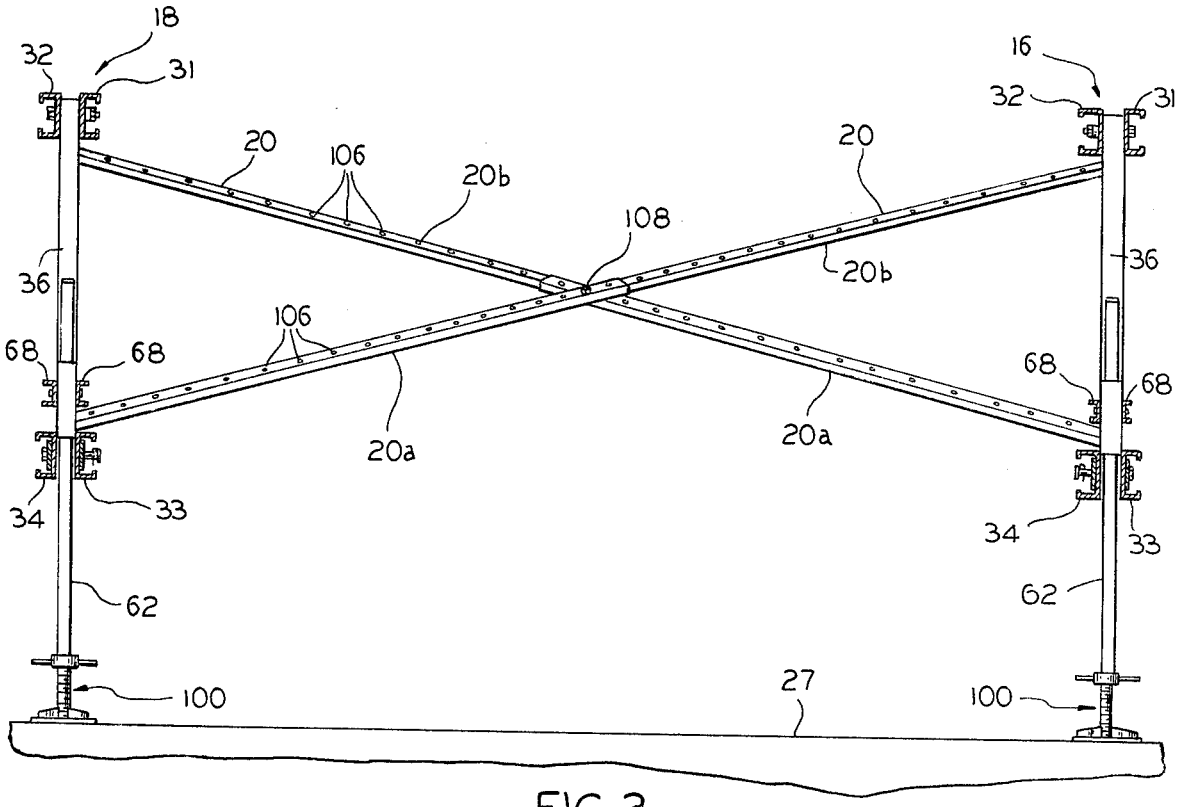
FIG. 3 is a transverse sectional view of the shoring assembly unit illustrated in FIG. 2, taken substantially on line 3—3 thereof and drawn to a slightly enlarged scale.
Figure 4:
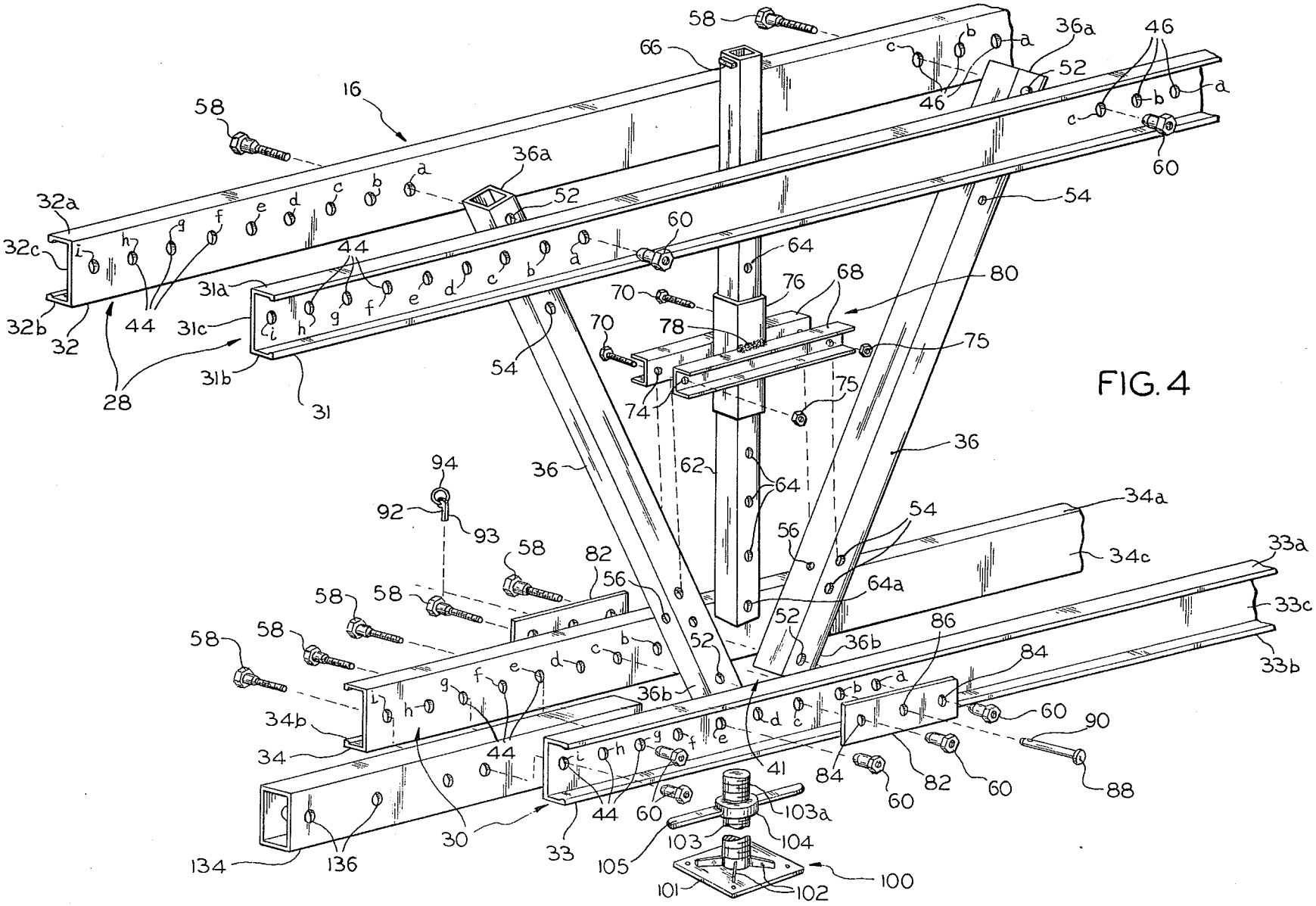
FIG. 4 is an enlarged fragmentary exploded perspective view of shoring apparatus as employed in the structures shown in the preceding views.

Referring to FIGS. 1–4, and particularly to FIG. 4, the shoring apparatus unit 16, representative of both units 16 and 18, is constructed of an upper pair 28 and a lower pair 30 of spaced apart parallel channel-shaped chords 31, 32 and 33, 34, respectively, having horizontally extending longitudinal axes. Rectangular tubular struts or web members 36, which have square cross sections in the illustrative embodiment, extend obliquely from the upper chord pair 28 to the lower chord pair 30 and between the chords in each pair, in a continuous longitudinal series of strut pairs 37–40 (FIG. 2) of like substantially V-shaped configuration having their apices 41 at the lower chord pair 30. The respective upper and lower ends 36*a* and 36*b* of the struts 36 are connected to the chords 31, 32 and 33, 34 of the upper and lower pairs 28 and 30, respectively, in a truss-like structure 42 (FIG. 2), by means subsequently described, which structure is adapted for supporting a load on the chords 31, 32 of the upper pair 28.

The chords 31–34 are structurally identical, differing only in length in the illustrative embodiment, and may be used as upper or lower chords, as required. Referring to the upper chord 31 illustrated in FIGS. 2 and 4 as representative, the chord includes upper and lower flanges 31*a* and 31*b* extending horizontally outwardly at right angles from a vertically extending integral web 31*c*. The web 31*c* is provided with a group of nine equidistantly spaced bolt holes 44 in an axial row adjacent to each of the opposite ends of the chord 31. For convenience of reference, the individual bolt holes 44 in each group are identified by the letters *a* through *i*, commencing at the inner ends of the rows. At equidistantly spaced intervals along the chord 31, intermediate groups of three equidistantly spaced bolt holes 46 are provided in the web 31*c*, in axial rows of holes identified by the letters *a* through *c* and having the same spacing as the bolt holes 44 in the end groups. There are three of such intermediate groups of bolt holes 46 in the upper chords 31 and 32, and two of such intermediate groups in the lower chords 33 and 34. The bolt holes 44 and 46 in each chord of a pair are in transverse register or alignment with the corresponding holes of the remaining chord of the pair. As seen in FIG. 2, the upper chord pair 28 extends outwardly beyond the lower chord pair 30 at both ends thereof, and the groups of bolt holes 44 and 46 in the upper chord pair 28 are in longitudinally offset or staggered relation to the groups of bolt holes 44 and 46 in the lower chord pair 30.

The struts 36 have a bolt hole 52 in each of the upper and lower ends 36*a* and 36*b* thereof, adjacent to their extremities, and pairs of bolt holes 54 spaced inwardly thereof, such holes 52 and 54 extending through the struts and facing laterally of the structure 42. Each strut also has a bolt hole 56 facing longitudinally of the structure 42, between the inner bolt holes 54 adjacent each end of the strut. The end bolt holes 52 of the struts 36 each register with one of the bolt holes 44 or 46 in the webs 31*c*, 32*c*, 33*c* and 34*c* of the respective chords 31–34, the registering chord hole being one of those identified by the letters *a* and *c*.

Figure 5:
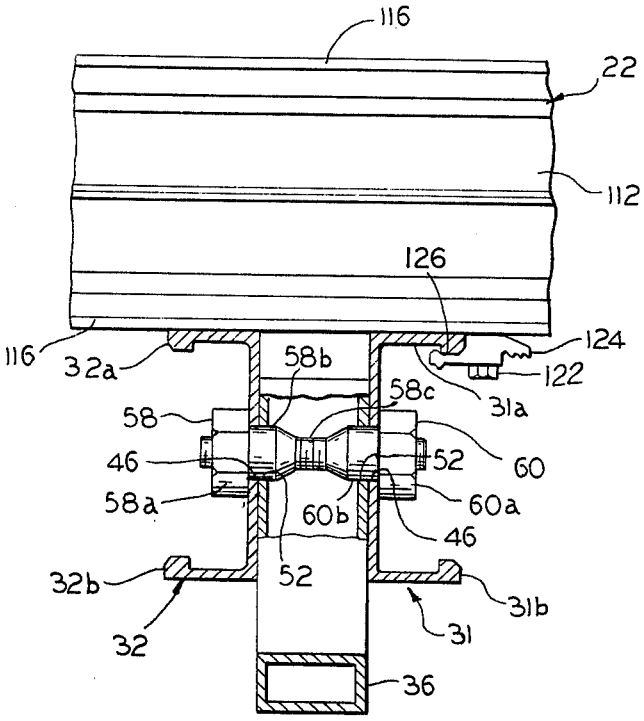
FIG. 5 is a further enlarged fragmentary sectional view of the shoring apparatus taken adjacent the top thereof, and showing its connection to a structural member in the formwork.

The chords 31–34 and the struts 36 are connected together in the truss-like structure 42 by connecting bolts 58 and connecting nuts 60 threaded thereon. Referring particularly to FIG. 5, each bolt 58 has a hexagonal head 58*a*, a generally cylindrical shank 58*b*, and a threaded stem 58*c* of reduced diameter with respect to the shank, which is inserted in a threaded bore in the head 58*a* and the shank 58*b* and welded in place therein. The nut 60 is similarly constructed of a hexagonal head 60*a* and a generally cylindrical shank 60*b* having a threaded opening therethrough for engagement with the stem 58*c* of the bolt. The bolts 58 are inserted through the bolt holes 44 or 46 in the chords 31–34 and the registering bolt holes 52 in the struts 36 and secured with the nuts 60 to connect the struts and the chords together in the structure 42. The shanks 58*b* of the bolts and the shanks 60*b* of the nuts are received in the registering bolt holes 44 or 46 and 52, as illustrated in FIG. 5, closely but not force-fitting, to produce tight connections for load transfer purposes while enabling the structure 42 to be assembled and disassembled readily and rapidly.

As noted above, the ends of the struts 36 are connected to the chords at the bolt holes 44*a* and 44*c*, or 46*a* and 46*c*, with the ends of two struts adjoining at each group of bolt holes in each chord pair, except where the end struts terminate at the upper chord pair 28. The axes of the bolt holes 44*b* and 46*b* between the adjoining strut ends may be referred to as the "panel points" of the truss-like structure 42. Such panel points are uniformly or equidistantly spaced apart the same distance along each chord pair 28 and 30, and the panel points of each chord pair are in longitudinally off-set relation to those of the other chord pair by a distance equal to one-half the distance between panel points. The vertical center lines 61 of the successive strut pairs 37–40 intersect the panel points of the lower chord pair 30, and likewise are uniformly spaced apart for a distance equal to the distance between panel points. The chords 31, 32 in the upper pair 28 extend longitudinally outwardly beyond the chords 33, 34 in the lower pair 30 at opposite ends of the structure 42 for a distance equal to one-half the distance between the center lines 61 of successive strut pairs 37–40.

Each of the shoring apparatus units 16 and 18 includes a plurality of elongated tubular legs 62 of rectangular cross section, being square in the illustrative embodiment, which extend vertically in the unit. In the illustrative embodiment, there are two such legs in each of the shoring apparatus units 16 and 18, and four legs in the shoring assembly unit 12. Each of the legs 62 has a vertical series of support pin holes 64, there being eight such holes in the illustrative embodiment, including a lower hole 64*a* adjacent the bottom of the leg. The support pin holes 64 extend through each leg 62 and between the opposite laterally facing sides thereof. The support pin holes 64 are spaced equidistantly along the length of each leg 62, except for the lower hole 64*a* and the next adjacent hole 64, which are closer together. At the top of each leg 62, on one of the longitudinally facing sides thereof, a stop block 66 is welded to the leg.

The upper portion of each leg 62 is inserted between the chords 33 and 34 in the lower pair 30 in each of the shoring apparatus units 16 and 18. Each leg also is inserted between the struts 36 in a selected one of the strut pairs 37–40 at the apex 41 thereof, there being provided suitable spacing between the lower ends 36*b* of the struts in each pair for that purpose. In the illustrative embodiment, legs 62 are inserted between the struts 36 of the end strut pairs 37 and 40 of each truss-like structure 42. The lower portion of each leg 62 in functional position extends below the structure 42 to provide support therefor. The legs 62 are vertically reciprocally movable relative to the structure 42, for adjusting the combined or overall height of the structure and the legs.

Referring to FIGS. 1, 2 and 4, a pair of spaced parallel horizontal strut crossbraces 68 in the form of channel bars interconnects the struts 36 in each of the strut pairs 37 and 40 having legs 62 inserted therebetween. The crossbraces 68 are connected at points on opposite sides of the struts 36 and spaced from the upper and lower chord pairs 28 and 30, by means of bolts 70 inserted through holes 74 in the webs of the crossbraces and through one of the inner bolt holes 54 in the pair of such holes adjacent the lower end 36*b* of each strut, and secured by nuts 75. A vertical leg guide member 76 in the form of a rectangular tube is fixedly mounted on the crossbraces 68 therebetween, by welds 78, thereby providing a leg guide assembly 80. The leg guide member 76 in the illustrative embodiment has a square cross section, and closely receives the leg 62 inserted between the interconnected struts 36 for guided vertical sliding relative movement therein. The stop block 66 prevents the leg 62 from falling out of the guide member 76.

The leg guide assembly 80 is readily and rapidly connected to and disconnected from any of the strut pairs 37–40 selected for insertion of a leg 62 between the struts thereof. It need not be employed with the remaining strut pairs. The leg guide assembly 80 functions both to maintain a leg 62 in proper vertical alignment and to brace the struts 36 connected thereto and thereby increase their lateral stability under load, but the leg guide assembly 80 carries no vertical load.

The support pin holes 64 of each leg 62 register successively with the bolt holes 44*b* in the lower chords 33 and 34, as the leg is raised and lowered. As noted above, the axes of the bolt holes 44*b* are at the center lines 61 of the strut pairs 37 and 40. The truss-like structure 42 may be supported on the legs 62 at a selected elevation, by inserting a support pin or the like through the bolt holes 44*b* adjacent each of the ends of the lower chords 33 and 34, and through a selected one of the support pin holes 64 in each leg. In the preferred construction of the invention, however, a relatively lightweight material is employed for fabricating the chords 31–34, such as an aluminum alloy. In view of the concentration of load stresses at the junctures of the lower chords 33 and 34 with the struts 36 and with the legs 62, it is preferred to employ load transfer members 82, which are in the form of rectangular plates, to transfer the load from the struts 36 to the legs 62. The load transfer members 82 and the legs 62 preferably are constructed of material having relatively high structural strength, and in the preferred embodiment, are constructed of steel. The struts 36, the crossbraces 68, and the leg guide member 76 like the chords 31–34, preferably are constructed of extruded aluminum alloy, and together with the load transfer members 82 and the legs 62 provide a relatively lightweight structure having the requisite strength and rigidity.

The load transfer members 82 are employed in pairs connected to the strut pairs 37 and 40, or other selected strut pairs, between which the legs 62 are inserted. One member 82 is disposed adjacent each of the webs 33*c* and 34*c* of the lower chords, on the outer side thereof. Each member 82 is provided with two bolt holes 84 adjacent opposite ends thereof, and a support pin hole 86 centrally disposed between and spaced from the bolt holes. The transfer member bolt holes 84 and support pin hole 86 are aligned in an axial row and are spaced apart between centers the same distance as the spacing of the bolt holes 44 and 46 in the chords 31–34. The bolt holes 84 of the transfer members 82 have the same diameter as the diameter of the chord bolt holes 44 and 46, and of the end strut bolt holes 52. The support pin hole 86, on the other hand, has a smaller diameter than the chord bolt holes 44 and 46, and, in particular, has a smaller diameter than the holes 44*b* and 46*b* in the lower chords 33 and 34, which latter holes are adapted for registry therewith.

The bolt holes 84 in each load transfer member 82 of a pair of members register with the lower chord bolt holes on opposite sides of the adjacent leg 62, which latter holes are identified as holes 44*a* and 44*c* in the embodiment of FIGS. 1, 2, and 4. At the same time, the load transfer member bolt holes 84 register with the bolt holes 52 at the lower ends 36*b* of the struts 36 between which the leg 62 is inserted. Connecting bolts 58 are inserted through such registering bolt holes of the load transfer members 82, the lower chords 33, 34, and the struts 36, for transferring the load forces from each truss-like structure 42 to its transfer members 82.

The support pin hole 86 in each load transfer member 82 of a pair of members registers with the lower chord bolt holes adapted to register with the leg support pin holes 64, which latter bolt holes are identified as holes 44*b* in the embodiment of FIGS. 1, 2 and 4. A headed support pin 88 is inserted through the support pin holes 86 of each pair of load transfer members 82 and through the lower chord bolt holes 44*b* registering therewith, and also through a selected one of the support pin holes 64 in the adjacent leg 62. The diameter of the support pin 88 is substantially the same as the diameters of the support pin holes 64 and 86, but less than the diameter of the bolt holes 44*b*. Consequently, the load forces are transferred from the load transfer members 82 to the leg 62 via the support pin 88, while the bolt holes 44*b* in the chords 33, 34 merely provide larger openings through the chords, with clearance to allow free passage of the support pin 88 therethrough.

The support pin 88 is provided with a hole 90 (FIG. 4) extending through the inserted end of the pin. The support pin 88 is detachably secured in place by a clip fastener 92 of conventional construction, having a finger 93 inserted through the hole 90 in the support pin and a ring 94 attached to the finger and swung down over the end of the support pin in use. Each truss-like structure 42 is vertically adjustably supported on the legs 62 at a selected elevation in the foregoing manner.

The legs 62 also are movable into out-of-the-way or retracted positions on each truss-like structure 42, in which positions the support pin holes 64*a* adjacent to the bottoms of the legs lie between the upper and lower margins of the chords 33 and 34 of the lower pair 30. That is, the lower edge of each leg 62 is elevated at least as far as the bottom surfaces of the lower flanges 33*b* and 34*b* of the lower chord pair, and preferably to locations above such flange surfaces, so that there is no obstruction to rolling the structure 42 on such flanges. The legs are raised for this purpose until their lower support pin holes 64*a* register with the bolt holes 44*b* in the chords 33 and 34 of the lower pair 30 and with the support pin holes 86 of the adjacent load transfer members 82. The legs 62 are supportable on the structure 42 in the out-of-the-way positions by inserting the support pins 88 through the then-registering support pin holes and bolt holes. The structure 42 then may be transported with the legs 62 carried thereby, and in the course of transportation, it may be moved on rollers which rollably engage the lower flanges 33*b* and 34*b* of the lower chord pair 30 without interference from the legs. The length of the legs 62 preferably is selected so that the upper edge or extremity of each leg lies between the upper surfaces, on the upper flanges 31*a* and 32*a*, and the lower surfaces on the lower flanges 31*b* and 32*b* of the upper chords 31 and 32 at this time. The legs 62 then do not encounter interference with the formwork supported on the upper chords, such as the illustrative formwork unit 14 or other formwork.

A screw jack 100 is provided for engagement with each of the legs 62 in the illustrative embodiment. Referring to FIG. 4, the jack 100 includes a base plate 101, four upstanding gussets 102 welded thereto at 90° angles therearound, and a screw 103 extending vertically from the center of the base plate and welded thereto and to the gussets. The jack also includes an internally threaded cylindrical nut 104 in threaded engagement with the screw 103, and a pair of handles 105 welded to and extending diametrically outwardly from opposite sides of the nut, for rotation of the nut thereby. The upper end 103*a* of the screw 103 is received within the tubular leg 62, while the lower edges of the leg seat on the nut 104. The jacks 100 provide fine adjustment of the overall height of the shoring assembly unit 12, whereas the legs 62 provide for coarse adjustment thereof. The legs 62 and the jacks 100 provide like adjustment of the height of the individual shoring apparatus units 16 and 18 when employed separately. When the shoring assembly unit 12 is transported from place to place, the jacks 100 may be carried in a suitable receptacle supported on the unit.

The unit crossbraces 20 which join the individual shoring apparatus units 16 and 18 together are constructed of telescoping outer and inner rectangular tubular sections 20*a* and 20*b*, respectively, which have a row of holes 106 therethrough. The crossbraces are joined together in X-fashion by means of a bolt 107 (FIG. 1) which extends through registering holes 106 in the crossbraces at their intersection and is secured by a nut 108 (FIG. 3). The ends of the crossbraces 20 are secured to struts 36 in the shoring apparatus units 16 and 18. In the illustrative embodiment, the crossbraces are secured to the end struts 36, which are the outer struts in the end strut pairs 37 and 40. Bolts 109 (FIG. 1) are inserted through holes 106 in the crossbraces 20 and through the longitudinally facing bolt holes 56 (FIG. 4) adjacent opposite ends of the struts, and the bolts 109 are secured by nuts 110 (FIG. 2).

Figure 6:
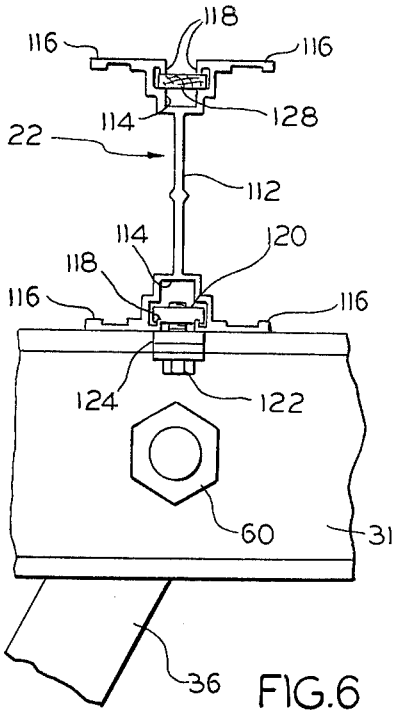
FIG. 6 is a fragmentary side elevational view of the structure illustrated in FIG. 5.

The form installation 10, illustrated in FIG. 1, is completed by connecting the structural members 22 to the upper chord pairs 28, and connecting the deck panels 26 to the structural members 22. FIGS. 5 and 6 illustrate preferred structure for making the connections, which structure is claimed in my copending U.S. Pat. application Ser. No. 658,515, filed Feb. 17, 1976. The structural member 22 is integrally constructed of a web 112, a pair of relatively small outwardly facing channels 114, and flanges 116 extending laterally from opposite sides of the channels therealong. Two spaced apart shoulders 118 extend inwardly at the mouth of each channel 114. A clamping nut 120 is inserted in the lower channel 114, and it seats on the shoulders 118 in the channel. A clamping bolt 122 is inserted through a corresponding opening in an attachment clip 124 and into threaded engagement with the clamping nut 120. A flange 126 on the attachment clip 124 extends inwardly beneath the upper flange 31*a* on the upper chord 31. When the clamping bolt 118 is tightened, the flange 126 of the clip 124 tightly engages the upper chord flange 31*a*. A like connection may be made between the structural member 22 and the remaining chord 32 of the pair, and in a preferred embodiment, connections to successive structural members 22 may be made with alternate ones of the chords 31 and 32. Like connections are made to the upper chord pairs 28 of both shoring apparatus units 16 and 18. In this manner, the structural members 22 are securely held in place on top of the shoring assembly unit 12.

A wooden nailing strip 128 is inserted in the upper channel 114 of each of the structural members 22. The nailing strips 128 are held in place by the shoulders 118 at the mouth of the upper channel 114. The deck panels 26 are nailed to the strips 128 by nails 130, as illustrated in FIG. 1. In this manner, the components of the form installation 10 are securely fastened together and may be transported safely on rollers and by crane.

Figure 7:
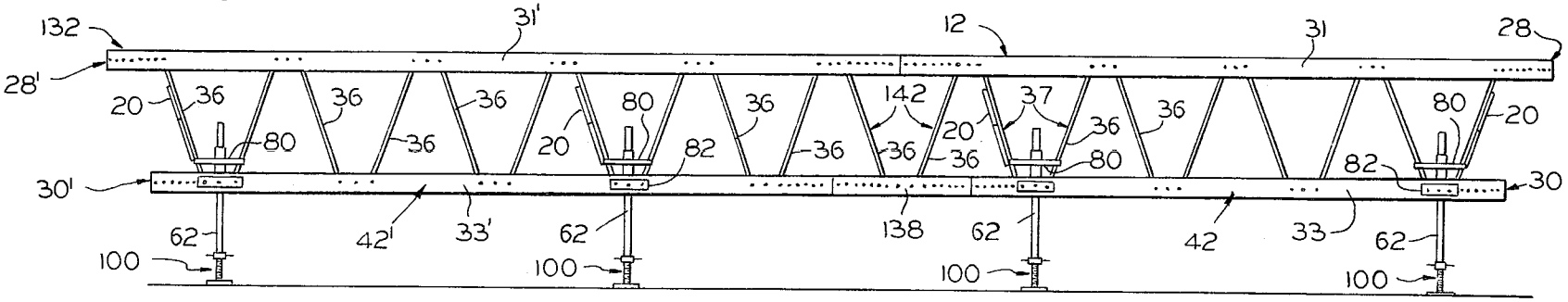
FIG. 7 is a schematic view on a reduced scale of a shoring assembly incorporating a shoring assembly unit as illustrated in FIG. 2 and an additional shoring assembly unit, in end-to-end relation.
Figure 8:
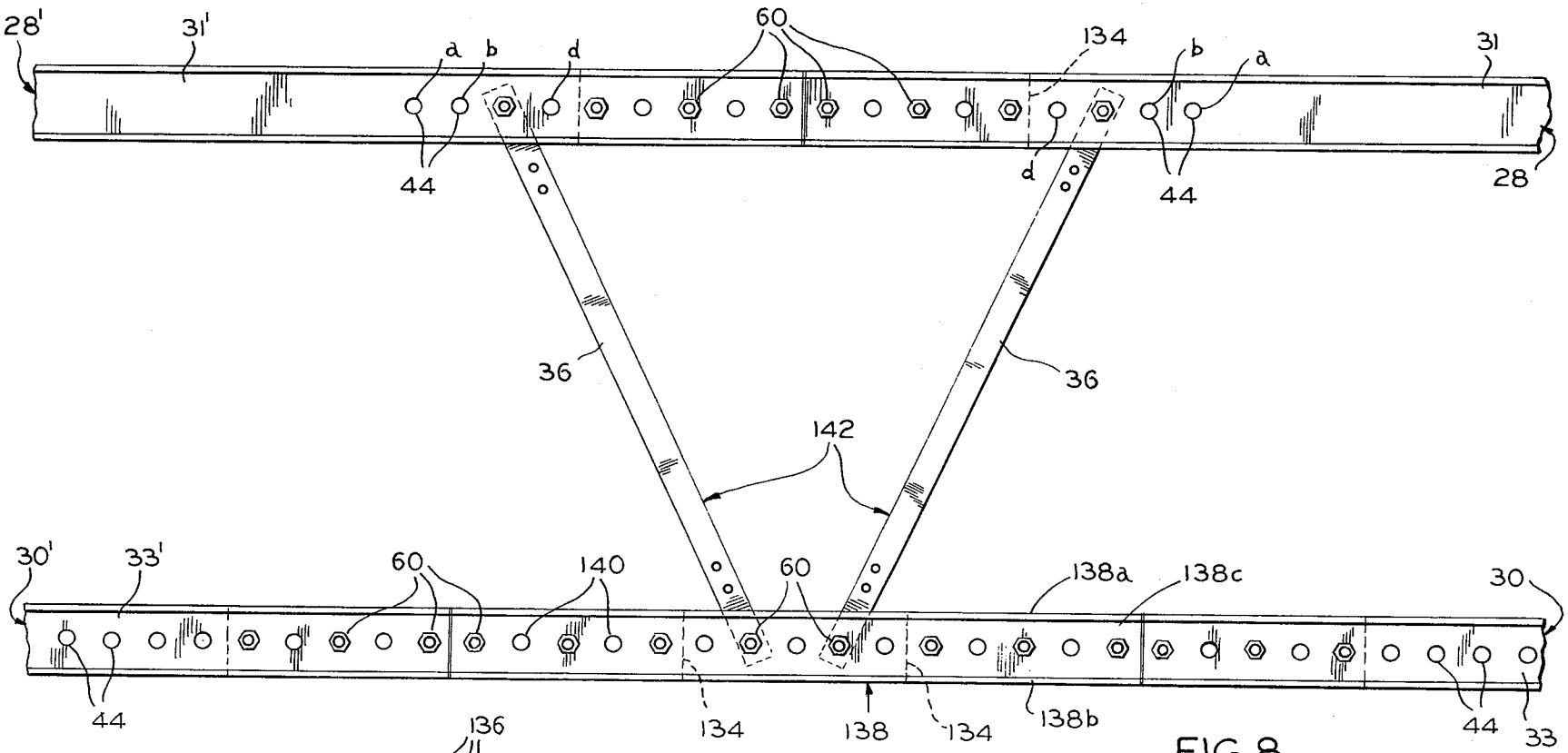
FIG. 8 is an enlarged fragmentary view of the assembly of FIG. 7, illustrating the structure at the joints between the two units.
Figure 9:
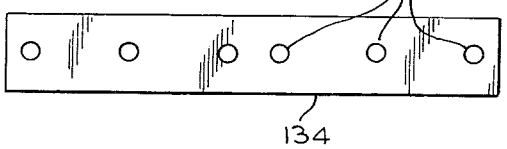
FIG. 9 is a side elevational view of a splice member as employed at the joints of the structure illustrated in FIG. 8.

The first shoring assembly unit 12 of FIGS. 1–3 may be joined to a second shoring assembly unit 132, to provide a continuous assembly of increased length, in the manner illustrated in FIGS. 7–9. The second unit 132 is in all respects the same as the first unit 12, except for being longer by one pair of struts 36 in each of its truss-like structures 42' and having one pair of cross-braces 20 shifted. The second unit 132 has in each structure 42' upper and lower chord pairs 28' and 30', respectively, which are like the corresponding chord pairs 28 and 30 of the first unit 12, except for being longer and having additional groups of intermediate bolt holes 46 (see FIG. 4), to accommodate the additional pairs of struts 36. The chords of the upper chord pairs 28 of the first unit 12 are connected in longitudinal alignment with and in end-abutting relation to respective chords of the upper chord pairs 28' of the second unit 132. A load-bearing splice member 134 (FIGS. 4 and 9) in the form of a rectangular tubular bar is inserted between the ends of the chords in each of the adjacent pairs 28 and 28' and bridges the joint therebetween, as illustrated in FIG. 8. The splice member 134 is provided with six longitudinally aligned and spaced apart bolt holes 136 extending therethrough and having the same diameters as the chord bolt holes 44. Three of the holes register with the bolt holes 44*e*, 44*g*, and 44*i* (see FIG. 4) in each of the upper chords 31 and 32 in each upper pair 28, and the remaining bolt holes 136 register with like holes in the chords in the adjacent pair 28'. Connecting bolts 58 (see FIG. 4) are removably inserted in the registering bolt holes and secured with connecting nuts 60 (as seen in FIG. 8) to provide a rigid connection, in the manner previously described and illustrated for the connection of other parts.

Referring to FIGS. 7 and 8, the lower chord pairs 30 and 30' of the first and second shoring assembly units 12 and 132 are connected together by means of channel-shaped load-bearing bridge members 138. The bridge members 138 have upper and lower flanges 138*a* and 138*b* extending horizontally outwardly from webs 138*c*, and such structure thereof is identical to the previously-described structure of the chords 31–34. The web 138*c* of each bridge member 138 is provided with an axial row of bolt holes 140 having the same diameters and spacing as the chord bolt holes 44. The bridge members 138 have lengths equal to the distance between the center lines 61 of the successive strut pairs 37–40 in the first shoring assembly unit 12, which distance is the same in the second unit 132. The bridge members 138 are employed in pairs of spaced apart parallel members bridging the spaces between aligned lower chord pairs 30 and 30' in the adjacent assemblies 12 and 132, with the bridge members in longitudinal alignment with and in end-abutting relation to respective chords of the chord pairs 30 and 30'.

The opposite ends of each pair of bridge members 138 are connected to respective lower chord pairs 30 and 30' by means of splice members 134. A splice member 134 is inserted between each pair of lower chords 30 and 30' and between each adjacent pair of bridge members 138, bridging the joint therebetween. The bolt holes 136 in one half of each splice member 134 register with the bolt holes 44 in a lower chord pair 30 or 30', and the bolt holes 136 in the remaining half register with the bolt holes 140 in a pair of bridge members 138. The chords in the lower pairs 30 and 30' and the bridge members 138 are connected to the splice members 134 by additional connecting bolts 58 and connecting nuts 60, in the same manner as in the connection between the upper chord pairs 28 and 28'.

Referring to FIG. 8, an additional rectangular tubular strut 36 extends from each of the adjacent upper chord pairs 28 and 28' in the shoring assembly units 12 and 132, to the pair of bridge members 138 bridging the corresponding lower chord pairs 30 and 30'. The struts 36 extend between the chords in the upper chord pairs 28 and 28', and between the bridge members 138, to provide an additional strut pair 142 of substantially V-shaped configuration like the strut pairs 37–40 of the first unit 12 and having its apex at the pair of bridge members 138. The bolt holes 52 in the upper ends of the struts 36 (see FIG. 4) register with the bolt holes 44*c* in the chords of the upper chord pairs 28 and 28'. The bolt holes 52 in the lower ends of the struts 36 register with bolt holes 140 in the bridge members 138, in like manner to the manner in which the bolt holes 52 in the strut pairs 37–40 of the first unit 12 register with the bolt holes 44 in the chords of the lower pair 30. Additional connecting bolts 58 are inserted through the registering holes at the upper and lower ends of the struts 36 in the additional pair 142, and are secured with nuts 60, to make the strut connections in like manner to the connections described above and illustrated in FIG. 5. It is to be noted that no leg 62 is employed in this area, and, therefore, the leg guide assembly 80 and the load transfer members 82 are not employed.

The chords in the upper pairs 28 and 28', the chords in the lower pairs 30 and 30', the bridge members 138, and the struts 36 in the additional pair 142 are connected together in the foregoing manner, in a unitary truss-like structure. Referring to FIG. 7, legs 62 may be employed along the resulting shoring assembly unit at locations which may be selected according to the load requirements. In the illustrative embodiment, a leg 62 is employed at every fourth pair of struts 36, and a leg guide assembly 80 and a screw jack 100 are employed with each leg. Load transfer members 82 are employed at each leg location.

In the foregoing manner, one or more modular shoring assembly units, such as illustrated by the units 12 and 132, may be employed, with the units joined end-to-end where more than one assembly is employed. While FIG. 7 illustrates the connection of two shoring assembly units 12 and 132, it will be apparent that individual shoring apparatus units, such as illustrated by the units 16 and 18, may be connected in end-to-end relation in like manner, for use in situations where an assembly of two parallel shoring apparatus units is not required. The system illustrated by FIG. 7 is useful when two units such as 12 and 132 are on hand and it is desired to join them. The complete assembly can be divided between the units 12 and 132, if desired, to accommodate variations in the sizes of floor slabs to be poured or to facilitate movement from place to place.

Shoring assembly units such as the illustrative units 12 and 132 are easily and rapidly assembled from symmetrical parts, including the chords 31–34, the struts 36, the leg guide assemblies 80, the load transfer members 82, the splice members 134, and the bridge members 138. Truss-like structures such as the illustrative structures 42 and 42' may be constructed in various lengths, employing chords of suitable length. The height of the truss-like structures may be varied, employing struts 36 of different length for that purpose, while the length of the legs 62 may be varied accordingly.

Units constructed according to the invention, such as the illustrative shoring apparatus units 16 and 18 and shoring assembly units 12 and 132, as well as combinations thereof, are advantageous in that the legs 62 may be positioned at any of the strut pairs therealong, to provide the amount of support required while minimizing the quantity and weight of the parts. The legs once positioned may be maintained in the same positions as the units are moved about, with no need for resetting them at each location, as with portable jacks. The legs provide a wide range of height adjustment, while precise adjustment may be made with the screw jacks. No vertical column members or the like are required in a truss-like structure according to the invention, such as the illustrative structures 42 and 42'. Rather, the truss-like structure is constructed essentially of horizontal upper and lower pairs of chords, and oblique struts.

While certain preferred embodiments of the invention have been shown and described, it will be apparent to those skilled in the art that various changes and modifications may be made therein within the spirit and scope of the invention. It is intended that such changes and modifications be included within the scope of the appended claims.

Having thus described the invention, what I claim as new and desire to secure by Letters Patent is:

1. Adjustable shoring apparatus which comprises upper and lower pairs of spaced apart parallel chords having horizontally extending longitudinal axes, the chords in said lower pair being spaced beneath and vertically aligned with respective chords in said upper pair, a plurality of struts extending obliquely from said upper chord pair to said lower chord pair and between the chords in each pair in a continuous longitudinal series of strut pairs of like substantially V-shaped configuration having their apices at said lower chord pair, the center lines of successive strut pairs being uniformly spaced apart, means connecting the upper and lower ends of said struts respectively to the chords of said upper and lower pairs in a truss-like structure constructed essentially of said struts and said chords and adapted for supporting a load on the chords of said upper pair, a plurality of vertically extending elongated legs each having a vertical series of support pin holes which extend transversely therethrough, said legs having upper portions inserted between the chords in said lower pair and lower portions extending below said structure to provide support therefor, and said legs being vertically reciprocally movable relative to said structure for adjusting the combined height thereof, the strut pairs in said series each being adapted for inserting one of said legs between the struts of and at the apex of the strut pair, said legs being inserted between said struts in respective selected strut pairs and being insertable alternatively between the struts of other strut pairs and at other locations along the length of said structure for supporting the structure alternatively at said other locations, and means for supporting said structure on said legs adjustably at varying elevations including means carried by the chords in said lower pair and defining support pin holes, said hole-defining means being adapted for disposing the pin holes thereof on opposite sides of each leg for registry with said leg pin holes successively in any of said locations of the leg, and a support pin removably insertable through a selected one of said pin holes in each leg and through the pin holes of said hole-defining means in registry therewith for transferring the load forces from said hole-defining means to said legs.

2. Apparatus as defined in claim 1 and wherein said support pin holes in each leg include a hole adjacent to the bottom of the leg, said legs also are movable into out-of-the-way positions on said structure in which said pin holes adjacent to the bottom of the legs are in registry with the pin holes defined by said hole-defining means while the leg bottoms lie between the upper and lower margins of the chords in said lower pair, and said legs are supportable on said structure in said latter positions by inserting said support pins through the then-registering pin holes, whereby said structure may be transported with said legs carried thereby and in the course of transportation may be moved on rollers which rollably engage and support said lower pair of chords without interference from said legs.

3. Apparatus as defined in claim 1 and including a crossbrace interconnecting the struts in each of said selected pairs at points on the struts spaced from said upper and lower chord pairs, and tubular leg guide means fixedly mounted on each of said crossbraces and receiving the leg inserted between the struts interconnected by the crossbrace for guided vertical sliding relative movement therein.

4. Apparatus as defined in claim 1 and wherein said strut ends and said chords are provided with registering bolt holes and bolts are inserted therethrough and secured with nuts to provide said strut connecting means, and said hole-defining means includes a pair of load transfer members adapted to be disposed adjacent to respective chords of said lower pair on opposite sides of and adjacent to each of said legs and extending longitudinally of the chords in opposite directions from the adjacent leg to said struts between which the leg is inserted in any of said locations of the leg, each of said members having bolt holes which register with said bolt holes in the latter struts and with the chord bolt holes registering therewith, said bolts also being inserted through said member bolt holes for transferring the load forces from said truss-like structure to the members, and each of said members also having a support pin hole disposed between said bolt holes thereof and registering with the support pin hole of the remaining member in its pair for registry of both member pin holes successively with said leg pin holes in the adjacent leg.

5. Adjustable shoring apparatus which comprises a plurality of units of apparatus as defined in claim 1 disposed in longitudinal alignment and adjacent to each other, the chords in said upper pair extending longitudinally outwardly beyond the chords in said lower pair at opposite ends of each unit for a distance equal to one-half the distance between the center lines of successive strut pairs in the units, the chords in said upper pair in each unit being in longitudinal alignment with and in end-abutting relation to the chords in said upper pair in each adjacent unit, and the chords in said lower pair in each unit being in longitudinal alignment with and spaced from the chords in said lower pair in each adjacent unit for distances equal to the distance between the center lines of successive strut pairs in the units, a pair of spaced apart parallel bridge members bridging the spaces between the chords in said lower pairs in adjacent units, said bridge members being constructed and arranged like respective ones of the latter chords and being disposed in longitudinal alignment therewith and in end-abutting relation thereto, splice means connecting together the abutting ends of the chords in said upper pairs, and the abutting ends of said bridge members and of the chords in said lower pairs in adjacent units, respectively, and an additional strut extending obliquely from each of said upper chord pairs in adjacent units to the said bridge member pair between the units, and extending between and connected to the chords and bridge members in each pair to provide an additional like strut pair of substantially V-shaped configuration having its apex at said latter bridge member pair, the spacing between the center line of said additional strut pair and the center line of each of the adjacent strut pairs in the units being the same as the spacing between the center lines of successive strut pairs in the units, whereby said truss-like structures of the individual units are joined together in a unitary truss-like structure having a continuous series of uniformly spaced strut pairs extending throughout its length.

6. Adjustable shoring apparatus which comprises upper and lower pairs of spaced apart parallel channel-shaped chords having horizontally extending longitudinal axes and having the flanges thereof extending horizontally outwardly and the webs thereof extending vertically, the chords in said lower pair being spaced beneath and vertically aligned with respective chords in said upper pair, a plurality of rectangular tubular struts extending obliquely from said upper chord pair to said lower chord pair and between the chords in each pair in a continuous longitudinal series of strut pairs of like substantially V-shaped configuration having their apices at said lower chord pair, the center lines of successive strut pairs being uniformly spaced apart, the opposite ends of said struts and the chord webs adjacent thereto having registering bolt holes extending transversely therethrough, bolts inserted through said registering bolt holes and secured with nuts to connect said struts and chords together in a truss-like structure constructed essentially of said struts and said chords and adapted for supporting a load on the chords of said upper pair, a plurality of vertically extending elongated rectangular legs each having a vertical series of support pin holes which extend transversely therethrough, said legs having upper portions inserted between the chords in said lower pair and lower portions extending below said structure to provide support therefor, and said legs being vertically reciprocally movable relative to said structure for adjusting the combined height thereof, the strut pairs in said series each being adapted for inserting one of said legs between the struts of and at the apex of the strut pair, said legs being inserted between said struts in respective selected strut pairs and being insertable alternatively between the struts of other strut pairs at other locations along the length of said structure for supporting the structure alternatively at said other locations, a crossbrace interconnecting the struts in each of said selected pairs at points on the struts spaced from said upper and lower chord pairs, rectangular tubular leg guide means fixedly mounted on each of said crossbraces and receiving the leg inserted between the struts interconnected by the crossbrace for guided vertical sliding relative movement therein, and means for supporting said structure on said legs adjustably at varying elevations including a pair of plate-like load transfer members adapted to be disposed adjacent to the webs of respective chords of said lower pair on opposite sides of and adjacent to each of said legs and extending longitudinally of the chords in opposite directions from the adjacent leg to said struts between which the leg is inserted in any of said locations of the leg, each of said members having bolt holes which register with said bolt holes in the latter struts and with said chord bolt holes registering therewith, said bolts also being inserted through said member bolt holes for transferring the load forces from said structure to the members, each of said members also having a support pin hole disposed between said bolt holes thereof and registering with the support pin hole of the remaining member in its pair for registry of both member pin holes successively with said leg pin holes in the adjacent leg, and a support pin removably insertable through a selected one of said pin holes in each leg and through said member pin holes in registry therewith for transferring the load forces from said members to said legs, said legs also being movable into out-of-the-way positions on said structure in which said pin holes adjacent to the bottoms of the legs are in registry with said member pin holes while the leg bottoms lie between the upper and lower margins of the chords in said lower pair, and said legs being supportable on said structure in said latter positions by inserting said support pins through the then-registering pin holes, whereby said structure may be transported with said legs carried thereby and in the course of transportation may be moved on rollers which rollably engage the lower flanges of and support said lower pair of chords without interference from the legs.

7. Apparatus as defined in claim 6 and wherein said strut pairs are provided with like patterns of bolt holes for bolting said crossbraces to any of said strut pairs.

8. Adjustable shoring apparatus which comprises a plurality of apparatus as defined in claim 6 in longitudinal alignment and adjacent to each other, the chords in said upper pair extending longitudinally outwardly beyond the chords in said lower pair at opposite ends of each unit for a distance equal to one-half the distance between the center lines of successive strut pairs in the units, the chords in said upper pair in each unit being in longitudinal alignment with and in end-abutting relation to the chords in said upper pair in each adjacent unit, and the chords in said lower pair in each unit being in longitudinal alignment with and spaced from the chords in said lower pair in each adjacent unit for distances equal to the distance between the center lines of successive strut pairs in the units, splice means connecting together the abutting ends of the chords in said upper pairs, said splice means including a bar inserted between and bolted to said chord ends and bridging the joint therebetween, a pair of spaced apart parallel channel-shaped bridge members bridging the spaces between the chords in said lower pairs in adjacent units, said bridge members being constructed and arranged like respective ones of the latter chords and being disposed in longitudinal alignment therewith and in end-abutting relation thereto, splice means connecting together the abutting ends of said bridge members and of the chords in said lower pairs in adjacent units, respectively, said latter splice means including a bar inserted between and bolted to said chord ends in each of the latter lower pairs and also inserted between and bolted to said bridge members and bridging the joint therebetween, and an additional rectangular tubular strut extending obliquely from each of said upper chord pairs in adjacent units to the said bridge member pair between the units, and extending between and bolted to the chords and bridge members in each pair to provide an additional like strut pair of substantially V-shaped configuration having its apex at said latter bridge member pair, the spacing between the center line of said additional strut pair and the center line of each of the adjacent strut pairs in the units being the same as the spacing between the center lines of successive strut pairs in the units, whereby said truss-like structures of the individual units are joined together in a unitary truss-like structure having a continuous series of uniformly spaced strut pairs extending throughout its length.

* * * * *